US009695662B2

(12) United States Patent
Mansukh et al.

(10) Patent No.: US 9,695,662 B2
(45) Date of Patent: Jul. 4, 2017

(54) METHOD AND SYSTEM FOR RETAINING A LOCK RING ON A CASING HANGER

(71) Applicant: Vetco Gray Inc., Houston, TX (US)

(72) Inventors: Mayur Mansukh, Houston, TX (US); Aniruddha D. Gadre, Houston, TX (US); Joseph William Pallini, Houston, TX (US); David Lawrence Ford, Houston, TX (US)

(73) Assignee: VETCO GRAY INC., Houston, TX (US)

( * ) Notice: Subject to any disclaimer, the term of this patent is extended or adjusted under 35 U.S.C. 154(b) by 300 days.

(21) Appl. No.: 14/522,010

(22) Filed: Oct. 23, 2014

(65) Prior Publication Data

US 2015/0114669 A1 Apr. 30, 2015

Related U.S. Application Data

(60) Provisional application No. 61/987,861, filed on May 2, 2014, provisional application No. 61/896,401, filed on Oct. 28, 2013.

(51) Int. Cl.

| | |
|---|---|
| ***E21B 33/04*** | (2006.01) |
| ***E21B 33/03*** | (2006.01) |
| ***E21B 19/06*** | (2006.01) |

(52) U.S. Cl.

CPC ..... *E21B 33/0415* (2013.01); *E21B 19/06* (2013.01); *E21B 33/03* (2013.01); *E21B 33/04* (2013.01); *E21B 33/0422* (2013.01)

(58) Field of Classification Search

CPC .. E21B 33/04; E21B 33/0415; E21B 33/0422; E21B 33/03

USPC ..... 166/382

See application file for complete search history.

(56) References Cited

U.S. PATENT DOCUMENTS

| | | | | |
|---|---|---|---|---|
| 3,437,356 | A * | 4/1969 | Todd | E21B 33/0422 175/423 |
| 3,721,292 | A | 3/1973 | Ahlstone | |
| 4,488,740 | A | 12/1984 | Baugh et al. | |
| 4,607,865 | A | 8/1986 | Hughes | |

(Continued)

FOREIGN PATENT DOCUMENTS

| | | | |
|---|---|---|---|
| GB | 2120300 | A | 11/1983 |
| GB | 2450408 | A | 12/2008 |
| GB | 2482969 | A | 2/2012 |

OTHER PUBLICATIONS

International Search Report and Written Opinion issued in connection with corresponding PCT Application No. PCT/US2014/062553 on Feb. 27, 2015.

*Primary Examiner* — George Gray
(74) *Attorney, Agent, or Firm* — Hogan Lovells US LLP

(57) ABSTRACT

A retention system for limiting axial and radial movement of a wellbore lock ring. The retention system includes pins for resisting axial movement of the lock ring and assemblies for limiting radial outward movement of the lock ring. The lock ring circumscribes and couples to a wellbore hanger. The pins project radially from the hanger into the lock ring and into slots, where the slots extend a distance along the inner surface of the lock ring. The assemblies also project radially into the hanger and each have a portion that registers with a channel on a lower end of the lock ring. Lock ring outer radial movement is limited by contact between the portions of the assemblies and inner surfaces of the channels.

17 Claims, 5 Drawing Sheets

(56) References Cited

U.S. PATENT DOCUMENTS

| | | | | |
|---|---|---|---|---|
| 5,002,131 | A * | 3/1991 | Cromar | E21B 33/04 166/208 |
| 5,247,996 | A | 9/1993 | Milberger | |
| 6,598,673 | B1 | 7/2003 | Hosie et al. | |
| 7,150,323 | B2 | 12/2006 | Ford | |
| 7,380,607 | B2 | 6/2008 | Thomas | |
| 8,171,996 | B2 | 5/2012 | Jennings | |
| 8,413,730 | B2 | 4/2013 | Gette et al. | |
| 8,662,185 | B2 | 3/2014 | Gette | |
| 2010/0116486 | A1* | 5/2010 | Minassian | E21B 33/04 166/88.1 |
| 2013/0068466 | A1 | 3/2013 | Ghumre et al. | |

* cited by examiner

FIG. 5
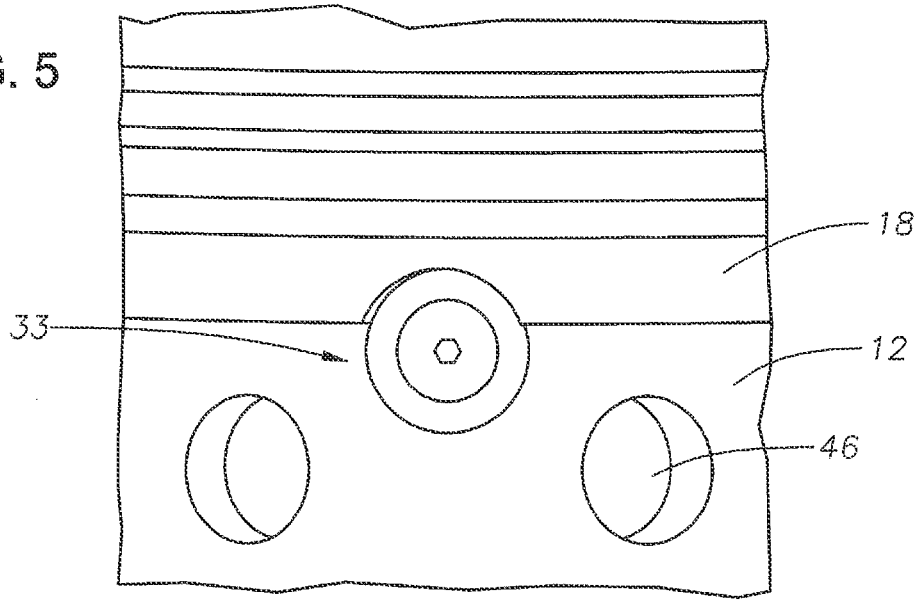
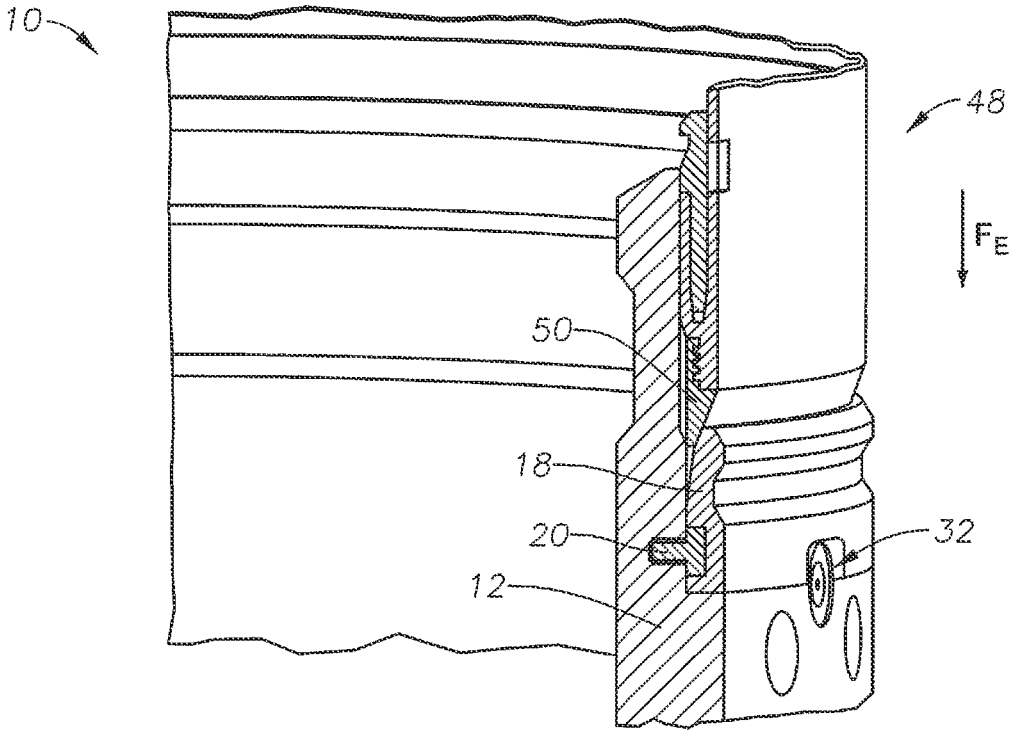
FIG. 6

METHOD AND SYSTEM FOR RETAINING A LOCK RING ON A CASING HANGER

CROSS REFERENCE TO RELATED APPLICATIONS

This application claims priority to and the benefit of, U.S. Patent Application Ser. No. 61/987,861 filed May 2, 2014 and of U.S. Patent Application Ser. No. 61/896,401 filed Oct. 28, 2013, the full disclosures of which are hereby incorporated by reference herein for all purposes.

BACKGROUND OF THE INVENTION

1. Field of Invention

The present disclosure relates in general to a system for coupling annular member to hanger used in a wellhead assembly.

2. Description of Prior Art

Wellheads used in the production of hydrocarbons extracted from subterranean formations typically include a wellhead assembly attached at the upper end of a wellbore formed into a hydrocarbon producing formation. Support hangers for suspending production tubing and casing into the wellbore are generally included within the wellhead assemblies. The casing lines the wellbore and isolates the wellbore from the surrounding formation. The tubing, which typically lies concentric within the casing, provides a conduit therein for producing the hydrocarbons entrained within the formation.

Wellhead assemblies also typically include a wellhead housing and a production tree atop the wellhead housing. Wellhead housings are often adjacent where the casing and tubing enter the wellbore. The production tree is commonly used to control and distribute the fluids produced from the wellbore and selectively provide fluid communication or access to the tubing, casing, and/or annuluses between the tubing and casing. Valves assemblies are typically provided within wellhead production tees for controlling fluid flow across a wellhead, such as production flow from the borehole or circulating fluid flow in and out of a wellhead.

Lockdown rings typically restrain each casing hanger within the wellhead housing to prevent relative axial movement between the casing hanger and wellhead housing. Usually proximate the lockdown rings are return passages that allow fluid flow during cementing operations. The passages typically are bored axially through the casing hangers and are in the form of slots along the inner surface of the wellhead housing.

SUMMARY OF THE INVENTION

An example of a wellhead assembly is described herein that is made of a wellhead hanger, a wellhead housing, a lock ring through which an axial lock down force is selectively transmitted between the wellhead hanger and wellhead housing, a slot through the lock ring that registers with a bore radially formed into an outer surface of the wellhead hanger, a pin that inserts into the bore and into the slot, so that the pin is in a path that interferes with axial movement of the lock ring, and a radial stop mounted on the wellhead hanger and in interfering contact with a radial path of the lock ring. Optionally, a portion of the slot projects fully through a radial thickness of the lock ring to define an aperture, and another portion of the slot extends from the aperture along a portion of the circumference of an inner surface of the lock ring and partially through the radial thickness of the lock ring. The radial stop can be made of fastener assemblies, wherein each fastener assembly includes a threaded fastener that anchors into the wellhead hanger, and a washer that projects radially outward from the threaded fastener. In this example, a channel can be formed on an outer radial surface of the lower end of the lock ring, and wherein the washer projects into the channel. Further in this example, the channel extends along a portion of the circumference of the lock ring. In one alternative, the lock ring rests on an upper facing surface of a shoulder, wherein the shoulder projects radially outward from the wellhead hanger, and wherein an outer radial portion of the upper facing surface projects radially upward to define a radial stop. The lock ring can be freely and selectively moveable with respect to the pins along a path radial to an axis of the wellhead hanger. In an alternative, the lock ring selectively projects into a profile formed on an inner surface of the wellhead housing, a wherein the lock ring rests on an upper surface of a shoulder on the wellhead hanger, and wherein the axial lock down force transmitted between the wellhead hanger and wellhead housing passes through the shoulder and the profile.

Also disclosed herein is a wellhead assembly which includes a wellhead hanger, a wellhead housing circumscribing the wellhead hanger, a lock ring between the wellhead hanger and wellhead housing and for transmitting a lockdown force between the wellhead hanger and wellhead housing, pins anchored in the wellhead hanger that are in interfering contact with axial movement of the lock ring, and radial stops on the wellhead hanger that limit radial movement of the lock ring. Slots can be provided in the lock ring that include apertures, and wherein the pins radially project through the apertures, in this example a portion of each slot extends past each of the apertures and along a portion of the circumference of the lock ring and partially through the thickness of the lock ring. In an example the radial stops incorporate threaded fasteners that project radially into the wellhead hanger, and have a portion projecting into a channel that is formed on a lower end of the lock ring and along an outer circumference of the lock ring. The radial stops can include a shoulder on the wellhead hanger defined where the radius of the wellhead hanger projects outward, and which provides a surface on which the lock ring is disposed, and a wall on an outer end of the shoulder that projects axially upward from the surface.

Also disclosed herein is a method of forming a wellhead assembly that includes providing an annular lock ring, mounting the lock ring onto a wellhead hanger, landing the wellbore hanger into a wellhead housing, limiting movement of the lock ring radially away from the wellhead hanger while landing the wellbore hanger into the wellhead housing, and resisting axial movement of the lock ring with respect to the wellhead hanger while landing the wellbore hanger into the wellhead housing. The method can further include urging the lock ring radially outward and into engagement with the wellhead housing so that a lockdown force is transmitted from the wellhead housing to the wellhead hanger through the lock ring. Axial movement of the lock ring can be limited by pins that are mounted in the wellhead hanger, and the radial movement of the lock ring can be limited by radial stops on the wellhead hanger that are disposed radially outward from an outer lateral surface of the wellhead hanger.

BRIEF DESCRIPTION OF DRAWINGS

Some of the features and benefits of the present invention having been stated, others will become apparent as the description proceeds when taken in conjunction with the accompanying drawings, in which:

FIG. 5 is a side view of an example of the radial retention system of FIGS. 3A and 3B.

FIG. 6 is a perspective and partial sectional view of a portion of an example of a wellhead assembly having the retention system of FIGS. 1A and 1B.

Figure 1A:
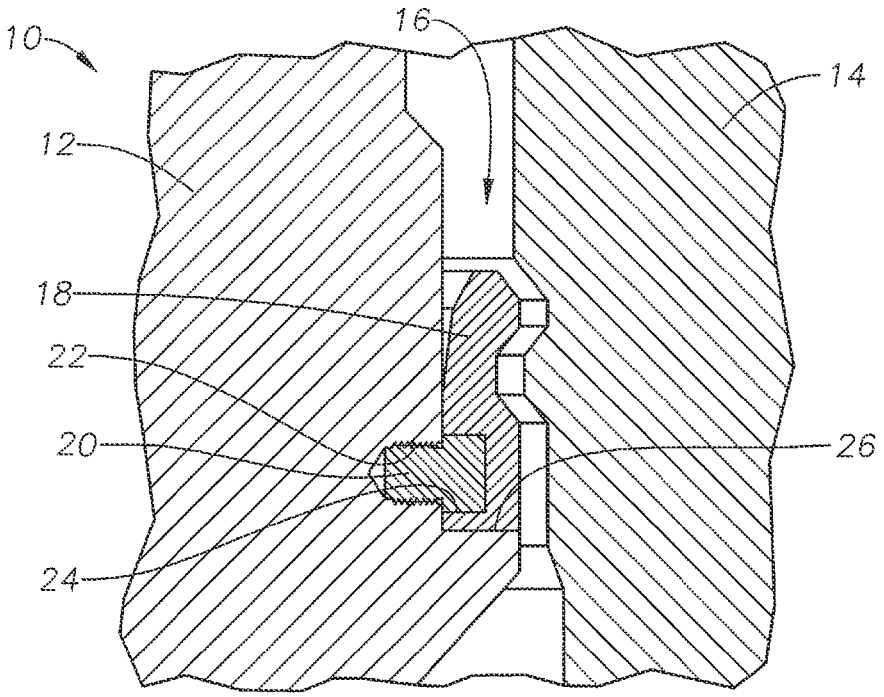
FIGS. 1A and 1B are side sectional views of an example of a retention system for a wellbore lock ring.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in side sectional view in FIG. 1A is an example of a portion of a wellhead assembly 10 used in conjunction with producing wellbore fluids from a wellbore (not shown). The wellhead assembly 10 includes a wellhead hanger 12 shown landed within a wellhead housing 14. In an example, a tubular string, such as a string of casing or tubing (not shown) has an upper end supported by the wellhead hanger 12, and depends down into the wellbore. An example of a lock ring assembly 16 is shown disposed in an annular space between the wellhead hanger 12 and wellhead housing 14. The lock ring assembly 16 of FIG. 1A includes an annular lock ring 18 and a pin 20 for coupling the lock ring 18 to the wellhead hanger 12. In the example of FIG. 1A, the pin 20 anchors to the wellhead hanger 12 by a threaded recess 22 formed radially into an outer surface of the wellhead hanger 12. The outer radial portion of the pin 20 extends into a slot 24 formed in the lock ring 18 and into interfering contact with axial movement of the lock ring 18 with respect to the wellhead hanger 12. The wellhead hanger 12 projects radially outward towards the wellhead housing 14 to form an upward facing surface which defines a shoulder 26; the lower end of the lock ring 18 is supported by the shoulder 26.

Figure 1B:
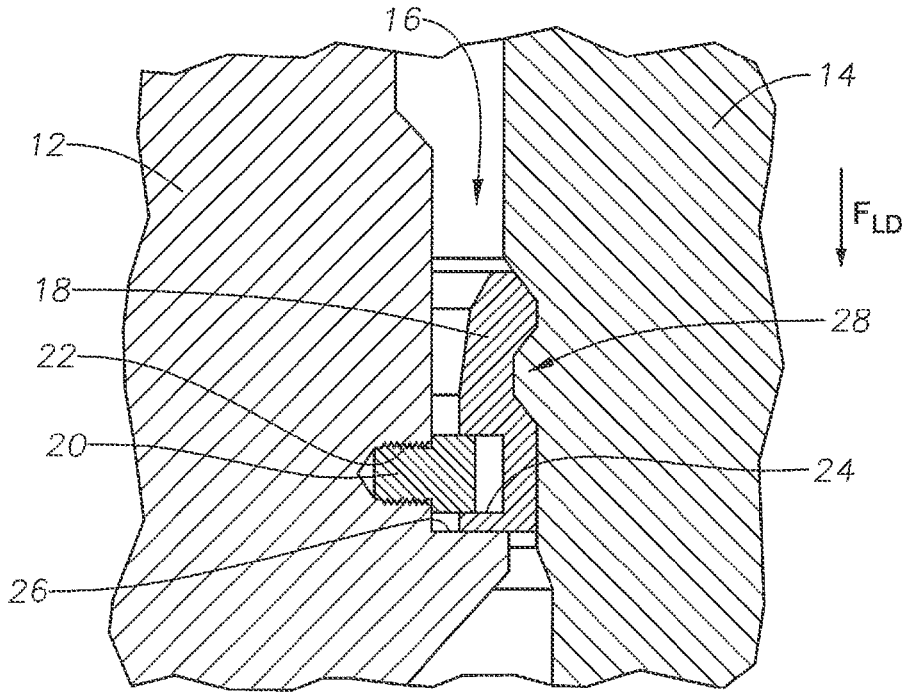

FIG. 1B illustrates in side sectional view an example of the lock ring 18 moved radially outward and into engagement with a profile 28 formed on an inner radial surface of the wellhead housing 14. The profile 28 has a shape complementary to the outer radial surface of the lock ring 18, so that an axial lock down force $F_{LD}$ can be transferred between the wellhead hanger 12 and wellhead housing 14 for axially coupling the wellhead hanger 12 to the wellhead housing 14.

Figure 2A:
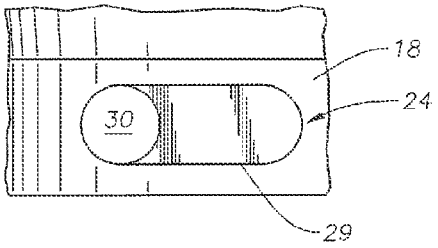
FIGS. 2A and 2B are side views respective of portions of the inner and outer surface of the lock ring of FIGS. 1A and 1B.
Figure 2B:
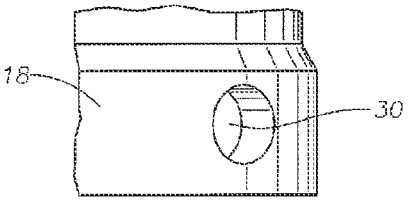

FIGS. 2A and 2B show perspective views respectively of portions of the inner and outer radial surfaces of the lock ring 18. As shown in FIG. 2A, a lateral section 29 of the slot 24 projects radially through only a portion of the thickness of the lock ring 18 and extends along a segment of the circumference of the lock ring 18. Adjacent the lateral section 29 is an aperture that projects radially through the entire thickness of the lock ring 18. In some instances, the pin 20 can insert through the aperture 30, or remain in the lateral section 29 thereby allowing limited rotational movement of the lock ring 18 but mostly limiting axial movement. The pins load against lateral section 29.

Figure 3A:
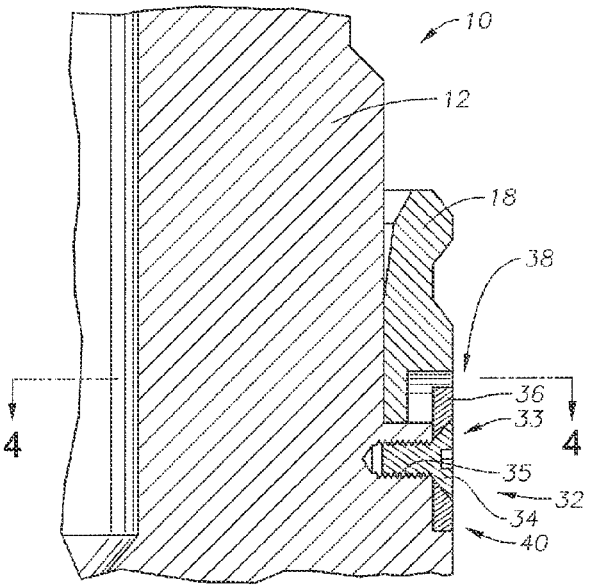
FIGS. 3A and 3B are side sectional views of an example of a radial retention system for an example of a wellbore lock ring.
Figure 3B:
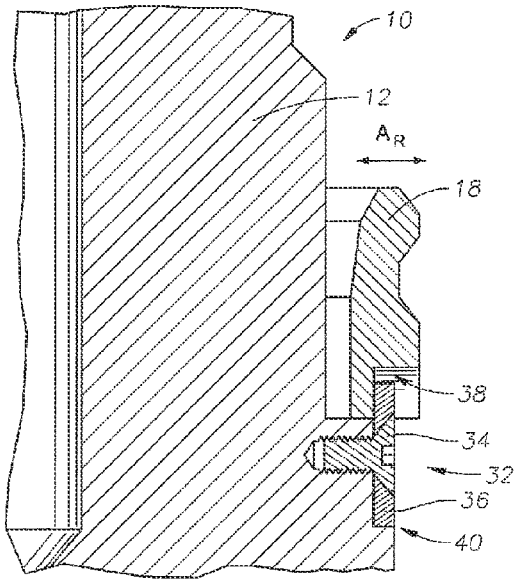

Referring now to FIG. 3A, the wellhead hanger 12 and lock ring 18 are shown in a side sectional view, and where the wellhead assembly 10 further includes a radial stop 32 for limiting radial movement of the lock ring 18 with respect to the wellhead hanger 12. The radial stop 32 of FIG. 3A includes a fastener assembly 33 that is made up of a threaded fastener 34 shown anchored into a threaded bore 35 that is formed radially inward from an outer surface of the wellhead hanger 12. The fastener 34 intersects an opening in a mid-portion of a disk like washer 36 and holds the washer 36 in place on the wellhead hanger 12. The washer 36 extends upward from fastener 34 and into a channel 38 shown formed into a lower end of the lock ring 18 and along the outer radial surface of the lock ring 18. Beneath bore 35, and on a side of bore 35 opposite shoulder 26, a pocket 40 is shown formed on an outer radial surface of wellhead hanger 12 and which has an upper end that intersects with an outer radial portion of shoulder 26. A lower end of washer 36 is shown disposed within pocket 40. As shown in FIG. 3B, the presence of the radial stop 32 limits outward radial movement of the lock ring 18, where the radial movement of the lock ring 18 is represented by arrow $A_R$. More specifically, the washer 36 and channel 38 are strategically dimensioned so that the radial travel of lock ring 18, as represented by arrow $A_R$, is held within a range that allows lock ring 18 to move into engagement with the wellhead housing 12, as shown in FIGS. 2B, 3B, but yet limits excessive outward radial movement of the lock ring 18 that might allow unwanted contact with other hardware and interfere with landing the wellhead hanger 12 within wellhead assembly 10.

Figure 4:
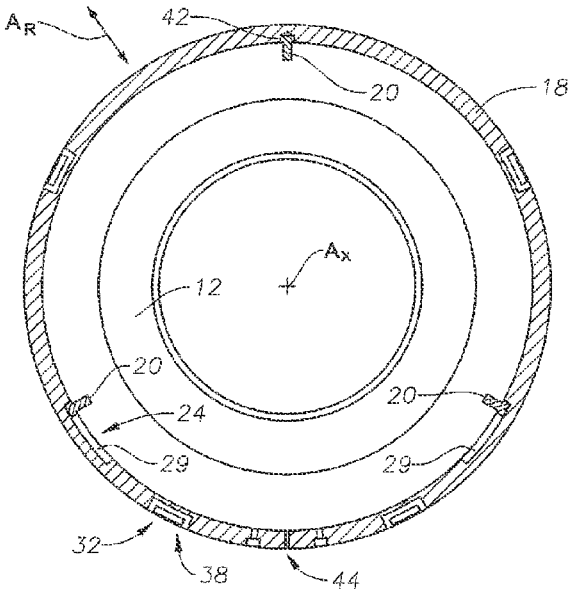
FIG. 4 is an axial sectional view of the lock ring of FIGS. 1A and 1B.

FIG. 4 is an axial partial sectional view of the lock ring 18 mounted onto wellhead hanger 12, and which is taken along lines 4-4 of FIG. 3A. In the example of FIG. 4 multiple pins 20 are shown, wherein some of the pins are intersecting lateral sections 29 of the slots 24, and wherein one of the pins 20 is shown projecting into an aperture 42 that extends part ways through the thickness of the lock ring 18, and whose diameter results in a close fit between the pin. 20 and aperture 42. Moreover, the placement of the radial stops 32 illustrates the limited outward radial movement of the lock ring 18 as represented by arrow $A_R$, and how the placement of the pins 20 limits axial movement of the lock ring 18 along axis $A_X$. In an example, pins 20 restrain the lock ring 18 to the load shoulder 26 when passing through a riser (not shown) during installation. Also illustrated in the example of FIG. 4 is a split 44 in the lock ring 18, which can allow for expansion and contraction. FIG. 5 is a perspective elevational view of a portion of the lock ring 18 mounted onto wellhead hanger 12. Shown in FIG. 5 are ports 46 that provide a path for a cement return flow.

FIG. 6 is a partial sectional perspective view of an example of the wellhead assembly 10, where a seal assembly 48 is included for sealing between the wellhead hanger 12 and wellhead housing 10 (FIG. 1B). Mounted coaxially to a lower end of the seal assembly 48 is a nose ring 50, which is a ring like member and used for locking the lock ring 18 with the wellhead housing 10. More specifically, applying an energizing force in a direction as represented by arrow $F_E$, urges the nose ring 50 axially downward between the lock ring 18 and wellhead hanger 12 to bias the lock ring. 18 radially outward and into engaging contact with the wellhead housing 10 as illustrated in FIG. 1B.

Figure 7:
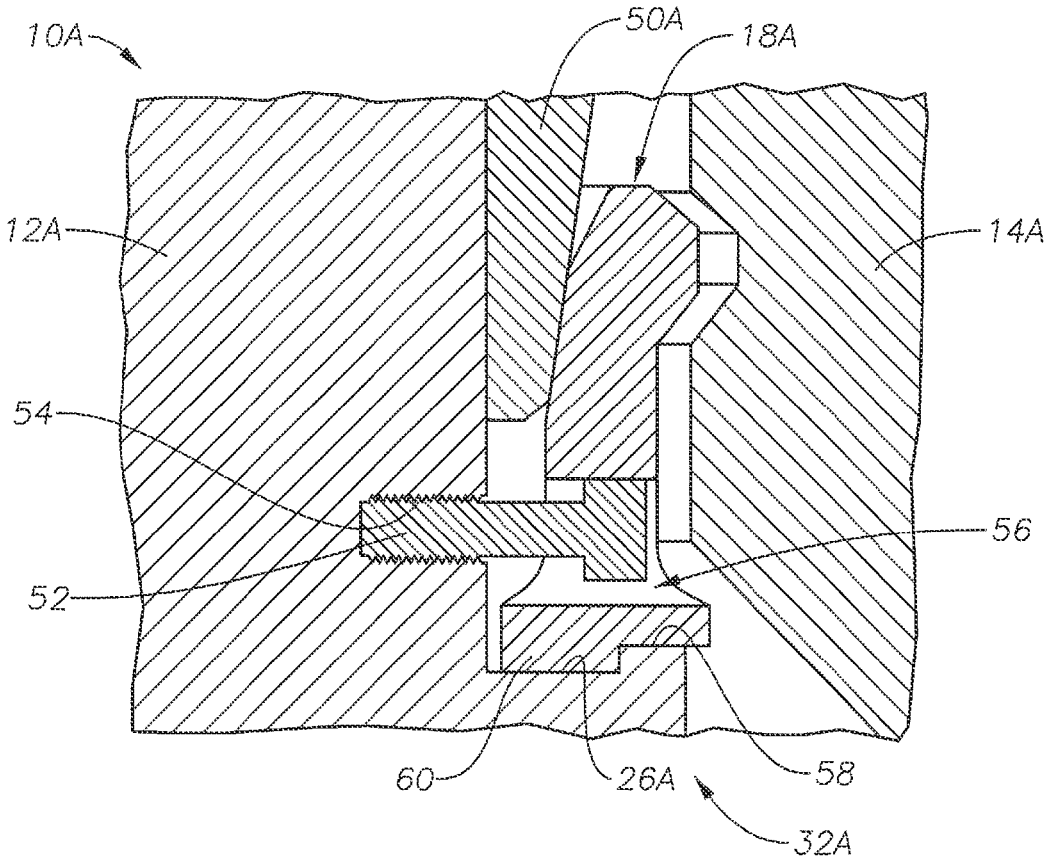
FIG. 7 is a side sectional view of an example of a wellbore lock ring with an alternative example of a retention system.

FIG. 7 is a side sectional view of an alternate example of a wellhead assembly 10A Where a threaded fastener 52 couples the lock ring 18A to the wellhead hanger 12A and provides a counter force for limiting axial movement of the lock ring 18A with respect to the wellhead hanger 12A. The fastener 52 has an end that engages a threaded bore 54 shown formed in an outer surface of the wellhead hanger 12A, and which projects radially into the wellhead hanger 12A. The fastener 54 also extends into an opening 56 shown extending radially through the thickness of the lock ring 18A, and which has a diameter slightly greater than a diameter of an enlarged head portion of the fastener 52. To limit outward radial movement of the lock ring 18A, a parapet 58 is shown formed on an outer radial end of shoulder 26A and which corresponds to a ledge 60 on a lower surface of the lock ring 18A. The combination of the parapet 58 and ledge 60 define an example of a radial stop 32A. Accordingly, the fastener 32, parapet 58, and ledge 60 combine to limit radial and axial movement of the lock ring 18A with respect to the wellhead hanger 12A. As indicated above, an advantage of limiting the axial and outward radial movement of the lock ring 18, 18A with respect to the wellhead hanger 12, 12A is that they can be lowered onto the wellhead assembly 10, 10A without the threat of the lock ring 18, 18A becoming inadvertently snagged on another piece of hardware on the way to the wellhead assembly 10, 10A. However, strategic dimensioning of the components that limit the radial and axial movement of the lock ring 18, 18A still allow sufficient radial movement of the lock ring 18, 18A so that it can be locked with the wellhead housing 14, 14A.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wellhead assembly comprising:

a wellhead hanger;

a wellhead housing;

a lock ring through which an axial lock down force is selectively transmitted between the wellhead hanger and wellhead housing, wherein the lock ring is urged into engagement with the wellhead housing upon insertion of a sealing device at least partially between the lock ring and the wellhead hanger;

a slot formed in the lock ring that registers with a bore radially formed into an outer surface of the wellhead hanger;

a pin that inserts into the bore and into the slot, so that the pin is in a path that interferes with axial movement of the lock ring; and a radial stop mounted on the wellhead hanger and in limiting contact with a radial path of the lock ring.

2. The wellhead assembly of claim 1, wherein a portion of the slot projects fully through a radial thickness of the lock ring to define an aperture, and another portion of the slot extends from the aperture along a portion of the circumference of an inner surface of the lock ring and partially through the radial thickness of the lock ring.

3. The wellhead assembly of claim 1, wherein the radial stop comprises fastener assemblies, wherein each fastener assembly comprises a threaded fastener that anchors into the wellhead hanger, and a washer that projects radially outward from the threaded fastener.

4. The wellhead assembly of claim 3, further comprising a channel formed on an outer radial surface of a lower end of the lock ring, and wherein the washer projects into the channel.

5. The wellhead assembly of claim 4, wherein the channel extends along a portion of the circumference of the lock ring.

6. The wellhead assembly of claim 1, wherein the lock ring rests on an upper facing surface of a shoulder, wherein the shoulder projects radially outward from the wellhead hanger, and wherein an outer radial portion of the upper facing surface projects radially upward to define the radial stop.

7. The wellhead assembly of claim 1, wherein the lock ring is freely and selectively moveable with respect to the pin along a path radial to an axis of the wellhead hanger.

8. The wellhead assembly of claim 1, wherein the lock ring selectively projects into a profile formed on an inner surface of the wellhead housing, and wherein the lock ring rests on an upper surface of a shoulder on the wellhead hanger, and wherein the axial lock down force transmitted between the wellhead hanger and wellhead housing passes through the shoulder and the profile.

9. A wellhead assembly comprising:

a wellhead hanger;

a wellhead housing circumscribing the wellhead hanger;

a lock ring between the wellhead hanger and wellhead housing, the lock ring transmitting a lockdown force between the wellhead hanger and the wellhead housing, wherein the lock ring is axially fixed with respect to the wellhead hanger;

a pin anchored in the wellhead that are in interfering contact with axial movement of the lock ring; and a radial stop on the wellhead hanger that limits radial movement of the lock ring.

10. The wellhead assembly of claim 9, wherein a slot in the lock ring comprises an aperture, and wherein the pin radially project through the aperture.

11. The wellhead assembly of claim 10, wherein a portion of the slot extends past the aperture and along a portion of the circumference of the lock ring and partially through the thickness of the lock ring.

12. The wellhead assembly of claim 9, wherein the radial stop comprises a threaded fastener that projects radially into the wellhead hanger, and wherein the radial stop comprises a portion projecting into a channel that is formed on a lower end of the lock ring and along an outer circumference of the lock ring.

13. The wellhead assembly of claim 9, wherein the radial stop comprise a shoulder on the wellhead hanger defined by an outward projection of the wellhead hanger, the shoulder providing a surface on which the lock ring is disposed, and a wall on an outer end of the shoulder that projects axially upward from the surface.

14. A method of forming a wellhead assembly comprising:

providing an annular lock ring;

mounting the lock ring onto a wellhead hanger;

landing the wellbore hanger into a wellhead housing;

limiting movement of the lock ring radially away from the wellhead hanger while landing the wellbore hanger into the wellhead housing;

resisting axial movement of the lock ring with respect to the wellhead hanger while landing the wellbore hanger into the wellhead housing; and urging the annular lock ring into engagement with the wellhead housing upon insertion of a sealing device at least partially between the annular lock ring and the wellhead hanger.

15. The method of claim 14, further comprising transmitting a lockdown force from the wellhead housing to the wellhead hanger through the lock ring.

16. The method of claim 14, wherein the axial movement of the lock ring is resisted by pins that are mounted in the wellhead hanger.

17. The method of claim 14, wherein radial movement of the lock ring is limited by radial stops on the wellhead hanger that are disposed radially outward from an outer lateral surface of the wellhead hanger.

* * * * *